United States Patent [19]

Meenan

[11] 3,994,669

[45] Nov. 30, 1976

[54] FURNACE

[76] Inventor: Cyril F. Meenan, 7349 Ridgeway, Skokie, Ill. 60076

[22] Filed: Nov. 19, 1975

[21] Appl. No.: 633,276

[52] U.S. Cl. ..... 431/165; 110/72 R; 431/353

[51] Int. Cl.[2] ..... F23M 5/00

[58] Field of Search .... 431/165, 352, 353, DIG. 11; 110/72 R; 29/420

[56] References Cited

UNITED STATES PATENTS

| | | | |
|---|---|---|---|
| 441,062 | 11/1890 | Gearing | 431/165 |
| 1,177,067 | 3/1916 | Amburgh | 431/165 |
| 1,625,082 | 4/1927 | Helbig | 110/72 R |
| 2,927,632 | 3/1960 | Fraser | 431/352 |

*Primary Examiner*—Edward G. Favors
*Attorney, Agent, or Firm*—Coffee and Sweeney

[57] ABSTRACT

A furnace and method of making the same are provided. The furnace has an integral poured refractory concrete combustion chamber wall having embedded therein a tertiary air supply system for supplying air around the burning fuels and air mixtures emitted from the burner. The tertiary air is introduced at positions spaced along the length of the combustion chamber.

The combustion chamber wall is produced by positioning manifolds and multiple air supply tubes spaced along the wall length with the tubes directed inwardly toward the flame and around it, but stoppng short of the inner surface of the poured concrete wall. Removable plugs or screws are inserted into the open tube ends and extend the tube ends to the position of the proposed inner surface of the wall.

Forms are provided for pouring the refractory concrete to form the wall. The outer form can be a steel plate or sheet or the like of relatively rigid structure. The inner form is flexible and preferably of a heat resistant and corrosion resistant material such as stainless steel. The inner form is supported and retained in position during pouring of the refractory concrete by use of an inflated bag or steel bands for bracing the form. After the concrete is poured and has set, the bands or bag can be removed. The plugs or screws, which extend through the flexible inner stainless steel wall are removed leaving a ports through the refractory concrete which connect the air supply tube ends with the combustion chamber interior. Thus, the portion of the air supply system closest to and entering into the combustion chamber has walls consisting of refractory material so that the less heat resistant supply tubes are not directly exposed to the full heat and corrosive atmosphere of the combustion chamber itself.

4 Claims, 5 Drawing Figures

FURNACE

BACKGROUND OF THE INVENTION

1. Field of the Invention

This invention relates to furnaces in general and is more particularly directed to an improved furnace structure and a method of making the same. Specifically, the furnace structure involved uses a shell of integral poured concrete and provides for the introduction of tertiary air at positions spaced around and along the length of the combustion zone.

2. Brief Description of the Prior Art and Development of the Invention

There have been problems in the past with regard to inefficiency in furnace combustion chambers in that combustion of fuel is incomplete. This has been particularly true in combustion chambers for furnaces of the type used in connection with steam boilers and the like. Such boilers and other heating systems are normally fed a mixture of fuel and primary combustion air through a nozzle extending into the combustion chamber. Secondary air enters around the nozzle.

In my U.S. Pat. No. 3,174,530, issued Mar. 23, 1965, I described such a combustion chamber associated with a steam boiler. In that construction, the combustion chamber is substantially enclosed in refractory brick. The boiler shell includes a number of horizontal return water tubes, each of which is in fluid communication at its forward end with a header into which is introduced. The burner is mounted in an end wall for introducing the mixture of fuel and air which is ignited to produce a flame extending generally over the length of the combustion chamber. Tertiary air can be introduced through the combustion chamber walls through copper supply tubes or the like, but it has been found that when such tubes are exposed to the immense heat of the combustion chamber, they tend to deteriorate and require replacement for proper continued operation of the furnace. Replacement of the tubes can, in some cases, require a complete rebuilding of the combustion chamber wall.

Another problem that has existed with furnaces generally is the deterioration of the combustion chamber wall over extended periods of use to the extent that the wall has to be relined regardless of the presence or absence of air delivery tubes. Such relining operations generally require rebuilding of the wall from refractory brick and are costly.

SUMMARY OF THE INVENTION

The present invention is directed to a new and useful combustion chamber construction for a furnace. The furnace uses a normal burner for introducing primary combustion air and fuel with secondary combustion air entering around the burner in the usual manner. The tertiary combustion air delivery system is a series of tubes embedded within the wall of the combustion chamber along the length thereof. The combustion chamber wall is composed of a set integral and connate mass of poured refractory concrete. The ends of the tertiary air delivery tubes stop short of the inner surface of the concrete wall so that they are not exposed to the extreme heat developed within the combustion chamber. Rather, the tertiary air delivery system continues from the tube ends in the form of bores or conduits having their inner surfaces composed of the refractory concrete rather than copper or other metal susceptible to destruction by the combustion chamber heat.

The method of this invention involves the construction of a furnace combustion chamber by a new and improved process. The combustion chamber can be constructed at a central plant for use in a furnace, such as in a boiler or the like, and inserted into the furnace within the prior combustion chamber, in lieu of lining or rebricking the combustion chamber. Alternatively, the combustion chamber can be built at the site of a furnace, separately for insertion or in situ.

Basically, the combustion chamber is produced by providing an outer rigid shell usually of steel or the like. The outer shell can be in any form, e.g. cylindrical, rectangular, square, or the like. Within the outer shell, there is positioned a flexible inner wall combustion chamber liner such as of stainless steel or the like, of the same general configuration as the outer shell, but smaller, leaving a space between the outer shell and the inner lining for pouring refractory concrete to form the wall. The tubes for delivering the tertiary air are assembled and placed in the space between the liner and the outer shell. The tube ends which project inwardly from a manifold portion of the tubing are plugged at their inner ends with removable screws or the like, which project through ports in the inner lining. The inner lining is supported by straps or an inflated bag or the like from the interior and refractory concrete is then poured between the inner lining and the outer shell to embed the tubing within the concrete and the concrete is permitted to harden. The plugs or screws are then removed from the ends of the inwardly projecting tubing within the concrete mass providing ports or bores extending the tubing as a conduit to a position within the inner lining. Prior to pouring the concrete, the tubing may be supported by braces extended between individual tubes. One or more manifold or tubing systems may be provided within the wall, each being supplied with tertiary air from an air conduit. Blowers and other supplemental apparatus may be used as desired or needed for delivery of the tertiary air.

While this invention is susceptible of embodiment in many different forms, there is shown in the drawings and will herein be described in detail certain specific forms thereof, with the understanding that the present disclosure is to be considered as an exemplification of the principles of the invention and is not intended to limit the invention to the embodiments illustrated.

DESCRIPTION OF THE PREFERRED EMBODIMENTS

Figure 1:
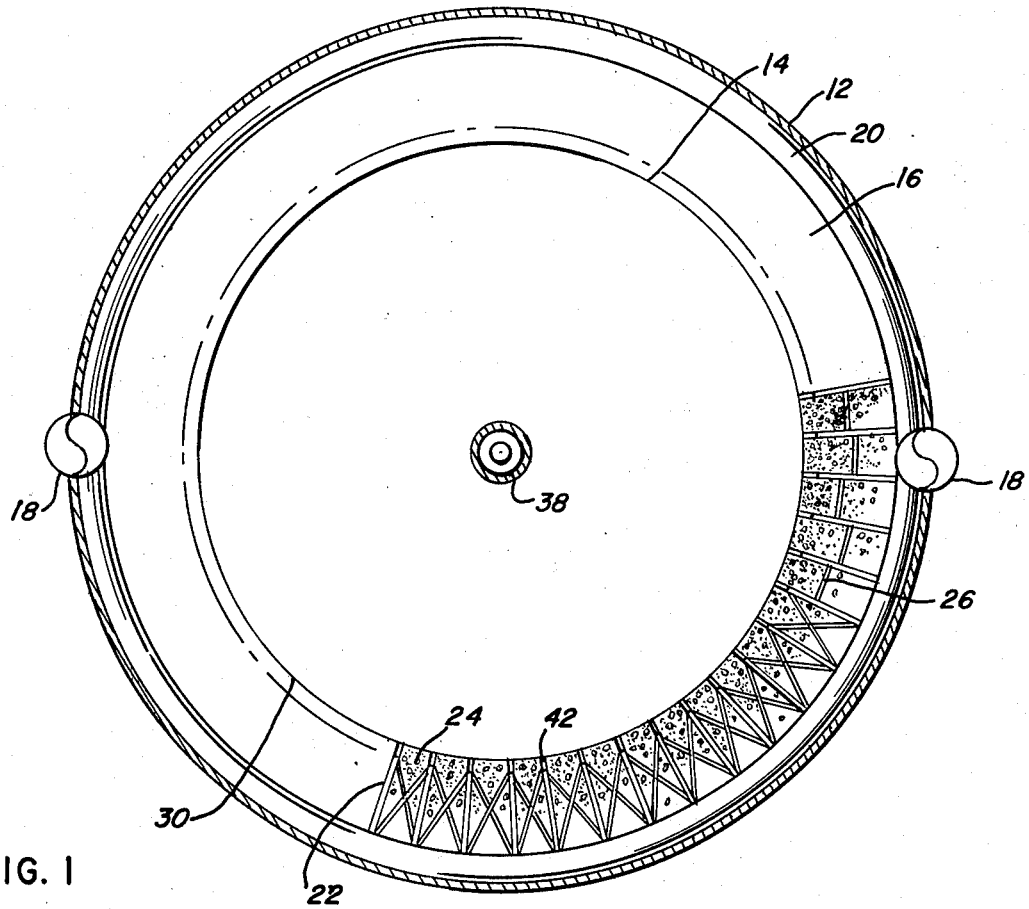
FIG. 1 is a vertical section through a horizontally disposed cylindrical combustion chamber constructed in accordance with one form of the present invention.
Figure 2:
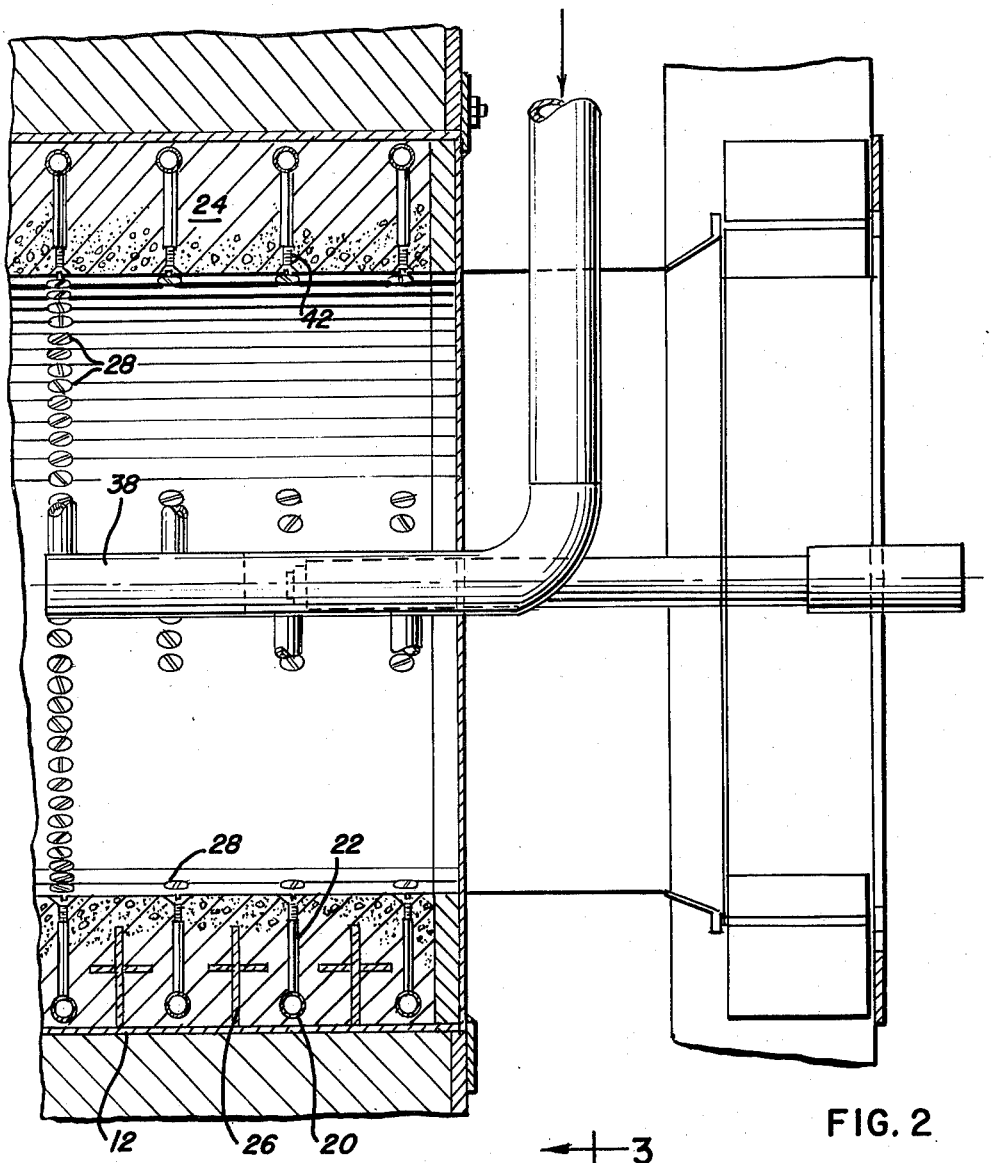
FIG. 2 is a vertical section taken longitudinally along the axis of the cylindrical combustion chamber shown in FIG. 1 and showing the combustion chamber as an insert within an existing boiler refractory for use in lieu of relining the boiler.

Turning first to FIGS. 1 and 2, there is provided a combustion chamber construction for use in a high temperature furnace. The combustion chamber includes an outer shell 12, usually of steel plate or the like, which is rigid for purposes that will become evident hereafter. The inner wall or lining 14 of the combustion chamber is of flexible material such as flexible stainless steel sheet metal and serves as a lining for the combustion chamber. Between wall 12 and lining 14, there is contained a mass of set refractory concrete 16 which embeds a tertiary air supply system including, in the embodiment shown, two or more headers 18 which deliver air to ring shaped manifolds in the form of conduits or jet rings 20 spaced equal distance from each other along the refractory concrete wall. The conduits or jet rings 20 in this embodiment are ring shaped to conform with the cylindrical combustion chamber wall and are positioned co-axially with respect to each other and with respect to the combustion chamber and burner. Projecting radially inwardly from each jet ring 20 is a plurality of copper supply tubes 22 for delivering secondary air toward the interior of the combustion chamber. The headers 18, jet rings 20 and tubes 22 are of a generally non-corroding material such as copper.

Note that the radially inwardly projecting tubes 22 stop short within the refractory material and do not extend to the stainless steel liner 14. Rather, ports or bores are provided toward the inner portion of the refractory concrete 16 and register with bores in the liner 14 for delivering air from the ends of the tubes 22 into the interior of the combustion chamber.

While pouring the refractory concrete to form the mass 16, it is desirable to support the tubes 22 so that they are not moved away from registry with ports in the inner liner 14 and so that they maintain their original alignment with respect to each other. Thus, copper tube support ribs 24 (FIGS. 1 and 4) are secured by brazing to adjacent tubes 22 to support tubes 22 from each other. Preferably, in the form of rib shown at 24, the ribs extend diagonally between tubes 22 secured to separate jet rings 20 so that ribs 24, which may appear to be crossed in FIG. 1, do not actually contact each other. See also FIG. 3. Additionally, or alternatively, refractory support T bars such as shown at 27 (FIG. 2) may be included in the refractory concrete for support purposes.

During the manufacture of the combustion chamber wall, the outer rigid shell 12 is first erected and the headers 18, conduits 20 and tubes 22 are positioned therewithin together with any supports 24 or 26 and T bars 27 which may be desired. The flexible stainless steel inner liner wall 14 is then positioned.

Once the headers 18, conduits 20 and tubes 22 are assembled in their proper supported positions screws 28, or like plugs, are driven into the inner open exposed ends of tubes 22 with the head of each screw or plug registering with a port in the flexible liner 14. An inflatable bag 30 (FIG. 1) is then placed within the liner 14 and inflated to support liner 14 against collapse during pouring of the refractory concrete. The concrete is poured in the space between shell 12 and liner 14, permitted to set to form and the inflatable bag 30 is then removed.

The combustion chamber wall is either poured in situ within an existing furnace structure or can be manufactured at a plant for later use. For example, FIG. 2 shows a form of the combustion chamber which has either been poured in place or inserted into an existing boiler refractory structure 32.

In any event, normally a furnace combustion chamber structure will have an end plate such as shown in at 34 (FIG. 2) which has openings or the like to permit entry of secondary air. A fuel burner nozzle 36 is supported through wall 34. In the system shown, fuel and air are introduced to the nozzle through supply line 38 extending through sleeve 40 in end wall 34.

Figure 4:
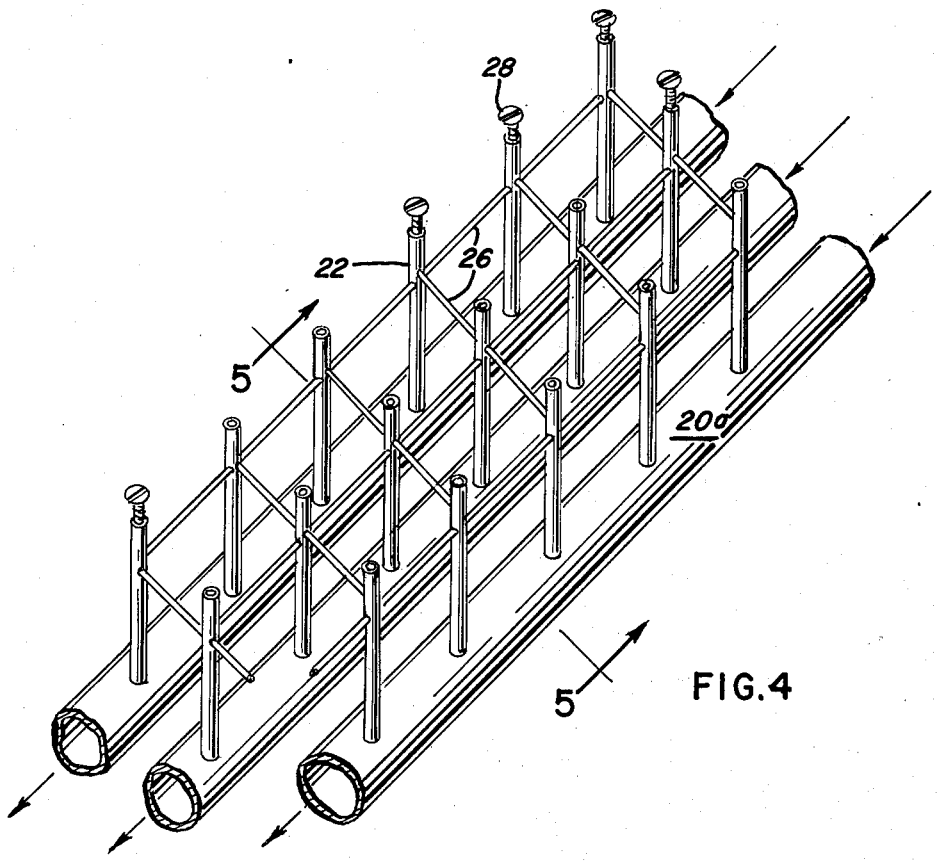
FIG. 4 is a perspective view of an assembly of secondary air supply tubes which is useful for embedding in refractory concrete in accordance with this invention to provide a flat wall for a combustion chamber, e.g. as would be used in making a rectangular or square combustion chamber.
Figure 5:
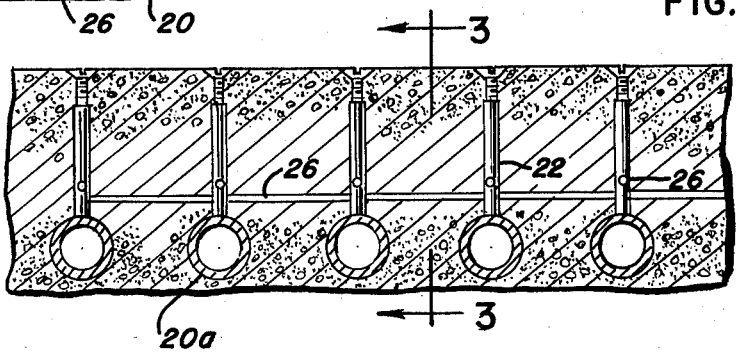
FIG. 5 is a section through a flat refractory wall such as would be taken along the lines 5—5 of FIG. 4 after pouring the refractory concrete around a structure similar to that in FIG. 4 but having shorter tertiary air delivery tubes.
Figure 3:
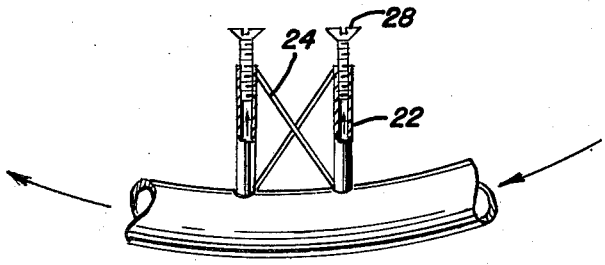
FIG. 3 is a view of an assembly of braced tertiary air supply tubing which can be used in constructing a combustion chamber in accordance with a form of the invention.

The system shown in FIGS. 4 and 5 is similar to that shown in FIGS. 1 through 3 except that it is intended for use in a flat refractory wall rather than in a cylindrical wall. Thus, the conduits or headers shown at 20 are straight rather than being ring shaped. Again, after molding the refractory wall 16 around the air supply system, the screws 28 are removed through the ports in the liner 14 to provide a refractory lined extension 42 of the tubes 22 into the interior of the combustion chamber.

It is intended that normal components of furnace combustion chambers can be used in combination with the present invention. For example, in addition to use of existing boiler refractory 32 discussed above, such modifications are adding insulation pads 44 (FIG. 2) can be made. The refractory material used in molding the integral wall is preferably a high temperature monolithic poured concrete. Further, it will be apparent that any number of air distribution tubes 22 can be supplied from a main header and that any number of manifolds 20 can be supplied from the headers 18. In the system shown in FIGS. 1 and 2 and in the preferred embodiment, 2 ring-shaped conduits or manifolds 20 are supplied from each header 18 and each manifold 20, in turn, supplies a large plurality of inwardly projecting tubes 22. Of course, the number of headers and manifolds and tubes employed will depend upon the desired length of the combustion chamber, the nature of the fuel used within the combustion chamber and other known factors. A proper balance of tertiary air and the primary and secondary air-fuel mixture will provide substantially complete combustion within the combustion chamber as is normally evidenced by a high or almost complete production of carbon dioxide from a carbon-based fuel such as a hydrocarbon.

Although I have described my furnace apparatus and method of manufacture and modification thereof, there will be further modifications of the device which will be evident from my description herein to those having ordinary skill in the art.

I claim:

1. A furnace comprising a connate poured refractory concrete wall defining the wall of the furnace combustion chamber, a burner generally centrally disposed within said wall for introducing fluid fuel and primary air for burning the fuel in said chamber, tertiary air supply consisting essentially of header means, a plurality of manifolds embedded in said wall and spaced along said wall for receiving tertiary air, a plurality of tubes also embedded in the poured concrete wall and extending from said manifold means inwardly through said wall and terminating short of the inner surface of said wall, and means at the inner ends of said tubes defined by the surface of said refractory material and defining passages conducting air from the tube ends through the remainder of said wall and into said combustion chamber.

2. A furnace comprising an insulating integral and connate poured refractory concrete wall defining an annular wall of the furnace combustion chamber, a burner generally centrally disposed within said annular wall and directed the length of said wall for introducing fluid fuel and primary air for burning the fuel in said chamber, a secondary air source, a tertiary air supply consisting essentially of header means and a plurality of manifolds embedded in said wall and extending around said combustion chamber, a plurality of tubes also embedded in the poured concrete wall and extending from said manifold means inwardly through said wall and terminating short of the inner surface of said wall, port or bore means at the inner ends of said tubes defined by the surface of said refractory material and defining passages for conducting air from the inner tube ends through the remainder of said wall and into said combustion chamber, and support means bracing said tubes within said wall.

3. A method of producing a refractory combustion chamber which method comprises erecting an outer structural shell for enclosing the combustion chamber, erecting a flexible wall within said outer shell spaced inwardly therefrom to define a space between said wall and shell, supporting said flexible wall from within, positioning in said space a secondary air supply system having a plurality of inwardly projecting air delivery tubes stopping short of said flexible wall, inserting plug means to extend into the end of each of said tubes, pouring settable concrete refractory material between said wall and shell and permitting the same to set and removing said flexible wall supporting means to provide a combustion chamber and disposing a burner generally centrally within said wall for introducing fluid fuel and primary air for burning the fuel in said chamber.

4. A method of producing a furnace having a refractory wall which method comprises erecting an outer structural shell for enclosing a combustion chamber; erecting a flexible heat resistant wall within said outer shell and generally co-axial therewith and spaced inwardly therefrom to define a space between said wall and shell, supporting said flexible wall from within with an inflatable bag, positioning in said space a plurality of manifold tubes spaced apart therealong, each of said manifold tubes having a plurality of inwardly projecting air delivery tubes stopping short of said flexible wall, inserting screw means to extend into the end of each of said tubes and in registry with ports in said flexible wall; supporting said tubes each from each other, attaching air supply header means to each of said manifolds for supplying air to the manifolds, thence through the tubes, pouring settable concrete refractory material between said wall and shell and permitting the same to set and form a refractory concrete wall embedding said manifolds, header means, tubes and support means and deflating said bag to provide a combustion chamber for said furnace and disposing a burner generally centrally within said wall for introducing fluid fuel and primary air for burning the fuel in said chamber.

* * * * *